US007673628B1

(12) United States Patent
Shulman et al.

(10) Patent No.: US 7,673,628 B1
(45) Date of Patent: Mar. 9, 2010

(54) OVEN RACK GUARD

(75) Inventors: Burt H. Shulman, Wappingers Fall, NY (US); David Frederick Erb, North Monmouth, ME (US)

(73) Assignee: JAZ Innovations, LLC, Toledo, OH (US)

( * ) Notice: Subject to any disclaimer, the term of this patent is extended or adjusted under 35 U.S.C. 154(b) by 913 days.

(21) Appl. No.: 10/838,041

(22) Filed: May 3, 2004

Related U.S. Application Data

(60) Provisional application No. 60/467,008, filed on May 1, 2003.

(51) Int. Cl.
*F24C 15/36* (2006.01)

(52) U.S. Cl. ..... 126/201; 126/332

(58) Field of Classification Search ..... 126/201, 126/332

See application file for complete search history.

(56) References Cited

U.S. PATENT DOCUMENTS

| | | | | |
|---|---|---|---|---|
| 2,186,857 | A * | 1/1940 | Davis | 126/273 R |
| 4,527,540 | A | 7/1985 | Ryan et al. | |
| 5,117,807 | A | 6/1992 | Graulich | |
| 6,302,095 | B1 | 10/2001 | Tolley et al. | |

* cited by examiner

*Primary Examiner*—Alfred Basichas
(74) *Attorney, Agent, or Firm*—Marshall & Melhorn, LLC

(57) ABSTRACT

A guard for protecting a cook or chef from burn injury from accidentally touching a hot oven rack comprising a sleeve of material mounted on the front rail of a metal oven rack. The sleeve is formed of a material having a thermal conductivity that is lower than than the thermal conductivity of the metal oven rack, so that when the guard is accidentally touched, insufficient thermal energy is transferred to an oven user to cause a burn, allowing the oven user to withdraw from the sleeve before injury can result. Preferably, the material forming the sleeve is heat resistant and has a lower thermal mass and thermal conductivity than the metal oven rack.

6 Claims, 3 Drawing Sheets

OVEN RACK GUARD

RELATED APPLICATION

This application is claiming the benefit, under 35 U.S.C. § 119(e), of the provisional application filed May 1, 2003 under 35 U.S.C. § 111(b), which was granted Ser. No. 60/467,008. This provisional application is hereby incorporated by reference in its entirety.

BACKGROUND OF THE INVENTION

Baking and roasting are common and popular cooking practices that require the use of an oven to perform the cooking process. For roasting meats, temperatures of 325 to 375 degrees F. are commonly used, while temperatures are often set much higher for baking, commonly to 400 to 450 degrees F. As might be expected, the oven interior including the oven racks reaches this temperature quickly and maintains these temperatures until the oven again cools down after use.

Ovens typically contain at least two wire racks used to hold bake ware and roasting pans. When the cook reaches into the oven to check on the cooking process or to remove cooked foods, it is not uncommon for him/her to accidentally brush an arm or hand against the upper rack. At the high temperatures typically used to cook/bake the food, a burn—often serious—may result.

The burn occurs almost instantly after contact with the hot metal rack, and is the result of two inherent physical properties of the metal rack: large thermal mass and high thermal conductivity. Roughly stated, thermal mass is the amount of heat contained in a given quantity of a material. Metal has a relatively high thermal mass, which means that there is a great deal of energy in the form of heat contained in the metal oven rack. Thermal conductivity is the speed at which heat transfers via conduction from one material to another. Metal has a very high thermal conductivity, making it an excellent conductor of heat. The result of this combination of a large thermal mass with a high thermal conductivity means that heat energy can be very quickly transferred from the metal oven rack to the skin, causing a burn to occur.

SUMMARY OF THE INVENTION

The current invention describes a thermal oven rack guard that secured over the front rail of a metal oven rack to protect against such accidental burns by virtue of using a material specially chosen to have a lower rate of conductive heat transfer than that of the metal oven rack, and preferably to have both a very low thermal mass and a very low thermal conductivity. Such a material does not contain significant heat energy per given mass, and such heat energy as exists is only slowly transferred via conduction to another object. In addition, the material is preferably a fabric constructed such that it has a high surface area to volume ratio, producing a high-loft, low density fabric that provides superior insulation with fewer fibers to actually contact the skin of the user. The practical result of this unique combination of low thermal mass and low thermal conductivity and fabric construction is that even though the thermal guard device reaches a high temperature during use, upon touching it the cook will sense the temperature of the guard and removes his/her hand long before any injury can result, protecting the cook against suffering an accidental burn.

DETAILED DESCRIPTION OF THE PREFERRED EMBODIMENTS

Figure 1:
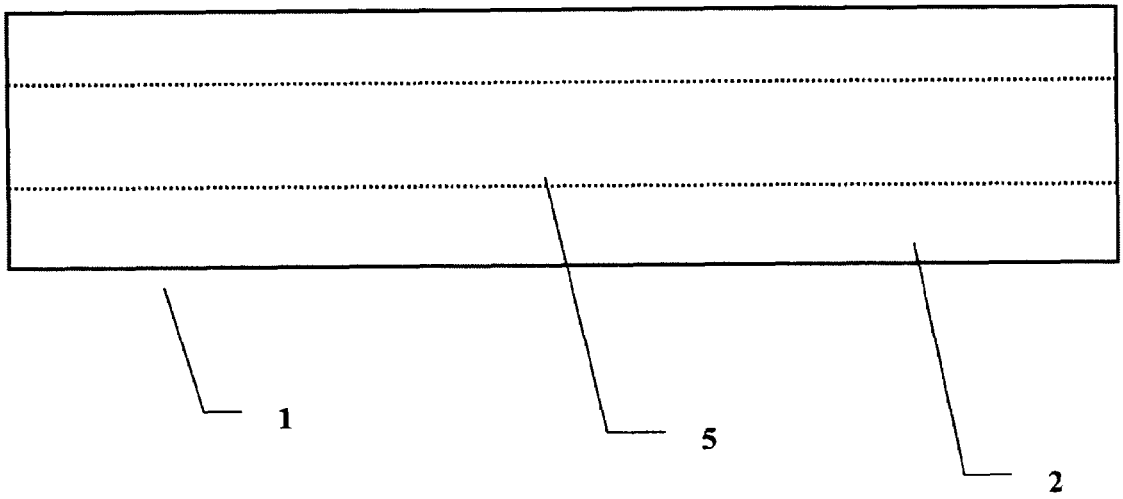
FIG. 1 is a top, somewhat schematic view of an embodiment of the oven rack guard of the invention in the open position.

The invention relates to a means of protecting a home or professional chef from severe burn injury from accidentally touching a hot oven rack by covering the front rail of the oven rack with a specially chosen material having a low thermal conductivity, and also preferably a low thermal mass. The thermal conductivity is most preferably equal to or less 1.0 BTU-in./hr$^2$ at room temperature.

In the preferred embodiment, this guard comprises a removable fabric sleeve or cover that is snapped or otherwise affixed over the front rail of a metal oven rack. The fabric is chosen to be a highly heat resistant material having the unique properties of low thermal mass and low thermal conductivity, such as Nomex brand (commercially available from E.I. du Pont de Nemours and Company) or a carbon-based high performance fabric of the type found in fire-fighter garb or racecar drivers' uniforms.

Ovens typically contain two or more metal racks to hold food during cooking. During the process of baking or roasting, oven temperatures reach up to 450 degrees F., and the metal oven racks reach this temperature, as well. Metal has a sizable thermal mass, measured in BTU/(pound*° F.). This means that a hot metal oven rack can hold a significant amount of heat energy. Metal also has a high thermal conductivity, measured in Btu*in/(h*ft$^2$*° F.). This means that the heat from a hot oven rack is quickly transferred via conduction to another object, such as a wrist or forearm accidentally brushed against it. This rapid transfer of a significant amount of heat can result in a serious burn, and is a common occurrence for home chefs.

The burns described above typically result when the home or professional chef accidentally brushes against the front rail of a hot oven rack when reaching into the oven to check on or remove cooked food. By covering that front rail with a sleeve or cover of heat resistant fabric specially chosen to have both low thermal mass and low thermal conductivity, accidental contact with such a sleeve will not transfer enough heat quickly enough to cause a burn. Even though the sleeve becomes hot during use, the home chef will easily sense the temperature of this fabric guard and remove his/her hand before injury can occur.

Not all heat resistant fabrics or materials possess the unique thermal properties of low thermal mass and low thermal conductivity. For example, glass fibers resist high temperatures well, but also have high thermal conductivity; fabrics made from such fiberglass transmit heat quickly and easily cause burns. Silicone is another material which withstands heat well and possesses a low thermal conductivity; however, its high thermal mass retains heat and also causes burns when the hot material is touched. The fabrics and/or materials chosen for this oven rack guard possess both properties—low thermal mass and low thermal conductivity—in the same material, making them ideal candidates for this purpose. This combination produces a product that holds little heat energy per unit of mass, and transfers it very slowly to the skin, protecting the user from injury.

In addition to the unique physical properties of the fiber, the construction of the fabric is also important in preventing burns. The surface area of the fiber relative to its volume as well as the specific heat of the fiber contributes significantly to thermal transfer. For a given volume of fabric the number of fibers in contact with the skin will directly contribute to the sensation of heat on the skin and the threshold for acceptable tolerance to the heat. The current invention preferably utilizes a number of low-density fabric constructions that include the use of a "woolen" spun yarn as well as napping to produce loft on the interior surface that is in contact with the oven rack. (The term "woolen" used here refers to how the yarn is spun, not a specific animal fiber.) This type of "woolen" system staple yarn typically creates a loftier, lower density fabric that allows air to circulate within the interstices of the material. In addition, napping of the yarns reorients many of the fibers perpendicular to the plane of the fabric thus producing a high compressive strength resilience that keeps the skin away from hot metal rack.

Any fabric construction that utilizes high temperature fibers with low thermal mass and low thermal conductivity sufficient to meet the requirements of the application and creates sufficient loft to insulate the skin from the hot metal rack may be used. This includes but is not limited to fabrics woven, nonwoven knitted, hydro-entangled, spunlaced, napped, sanded, and otherwise modified to impart loft or insulative properties through low-density construction. If woven, preferred yarn constructions may include plied or non-plied "woolen" system yarns of approximately 750-13500 denier.

The thermal conductivity and thermal mass of some materials at room temperature are provided in the Table below.

TABLE

| Material | Thermal Conductivity (BTU-in/hr$^2$) |
|---|---|
| Air | 0.2 |
| Steel (Oven Rack) | 319 |
| Glass | 7.2 |
| Wood | 13.8 |
| Silicone Rubber | 1.4 |
| Meta-Aramid | 0.26 |
| Melamine | 0.2 |
| PAN | 0.03 |

Referring to the drawings, FIG. 1 shows a top view of the oven rack guard 1 in the open position. In this view, the heat resistant fabric material 2 comprising the oven rack guard is the only feature visible. The metal snaps 3 that affix the oven guard to the oven rack front rail are not visible in this view. Of course, other methods can be used to secure the oven rack guard to the rack, including but not limited to hook and loop fasteners, buttons, clips, adhesives, stitching, etc. Thus, the sleeve or cover may be detachably or permanently secured to the front rail of the oven rack. Two seam lines 5 are shown in the drawing; these correspond to the hem that covers the metal snaps 3.

Figure 2:
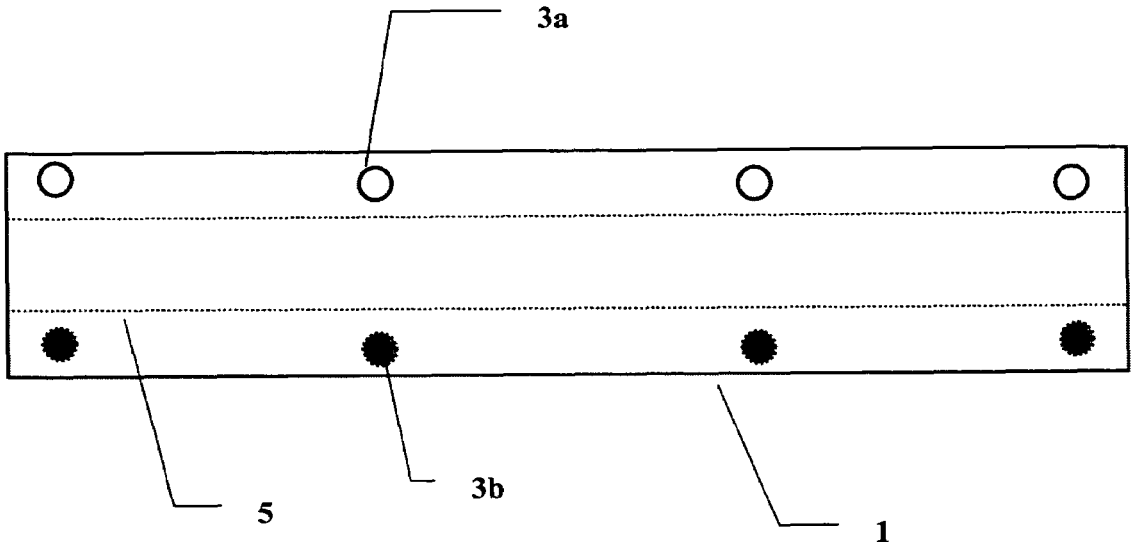
FIG. 2 is a bottom, somewhat schematic view of the oven rack guard of FIG. 1 in the open position.

FIG. 2 shows a bottom view of the oven guard 1 in the open position. In this view, the metal snaps 3 are visible evenly spaced along the outer edges of the oven guard 1. The male portions 3*a* of the metal snaps 3 are spaced along one outer edge, while the mating female portions 3*b* of the metal snaps 3 are similarly evenly spaced along the other outer edge of the oven guard 1. The seam lines 5 are again visible.

Figure 3:
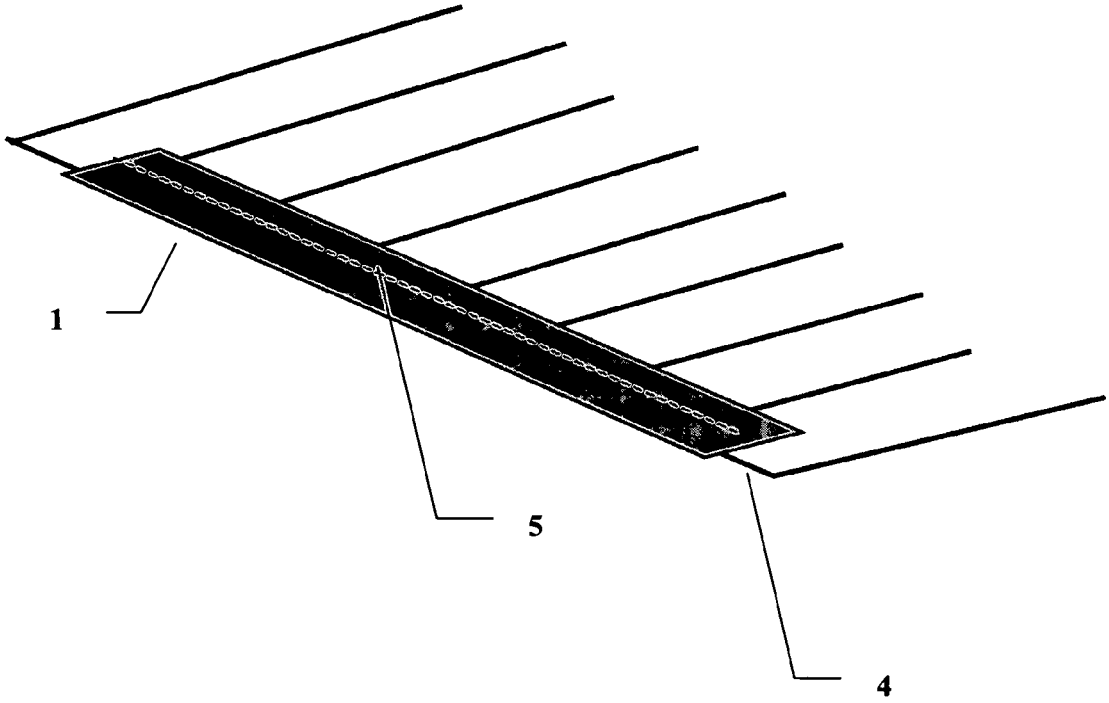
FIG. 3 is a perspective, somewhat schematic view of the oven rack guard of FIGS. 1 and 2 secured to the front rail of an oven rack.

FIG. 3 shows the oven rack guard 1 attached to the front rail 4 of an oven rack, as it would be in actual use. In this view, the oven guard is folded around the front rail 4 to form a sleeve thereabout, so that the metal snap male and female halves 3*a* and 3*b* can be snapped together, securing the oven guard to the front rail 4 of the oven rack. The metal snaps 3 are therefore not visible in this view. Only one seam line 5 is visible, since only half of the oven guard (1) is visible in this view.

In accordance with the provisions of the patent statutes, the invention has been described in what is considered to represent its preferred embodiments. However, it should be noted that the invention can be practiced otherwise than as specifically illustrated and described without departing from its spirit or scope.

What is claimed is:

1. A guard for protecting an oven user from burn injury from accidentally touching a hot oven rack comprising a cover formed of a material having a thermal conductivity that is lower than the thermal conductivity of the front rail of the metal oven rack and a means for mounting the cover on a front rail of the oven rack so that the cover can be detached and reattached without causing damage to the guard, and wherein the cover mounts on the front rail of a metal oven rack using a friction fit.

2. The guard of claim 1, wherein the cover is comprised of an injection molded plastic material.

3. The guard of claim 1, wherein the cover is comprised of an extruded plastic material.

4. The guard of claim 1, wherein the cover mounts on the front rail of a metal oven rack using metal snaps.

5. The guard of claim 1, wherein the cover mounts on the front rail of a metal oven rack using a heat resistant hook and loop type fastener.

6. The guard of claim 1, wherein the cover mounts on the front rail of a metal oven rack using an interlocking fastener system molded as an integral part of the cover.

* * * * *